United States Patent [19]

Ginsburgh

[11] 4,241,952

[45] Dec. 30, 1980

[54] SURFACE AND SUBSURFACE HYDROCARBON RECOVERY

[75] Inventor: Irwin Ginsburgh, Morton Grove, Ill.

[73] Assignee: Standard Oil Company (Indiana), Chicago, Ill.

[21] Appl. No.: 46,014

[22] Filed: Jun. 6, 1979

[51] Int. Cl.[3] ..... E21C 41/10

[52] U.S. Cl. ..... 299/2

[58] Field of Search ..... 299/2; 166/256, 258, 166/259

[56] References Cited

U.S. PATENT DOCUMENTS

| | | | |
|---|---|---|---|
| 4,018,280 | 4/1977 | Daviduk et al. | 299/2 |
| 4,117,886 | 10/1978 | Honaker | 299/2 X |
| 4,120,355 | 10/1978 | Knepper et al. | 299/2 X |

*Primary Examiner*—Ernest R. Purser

*Attorney, Agent, or Firm*—Frank J. Sroka; William T. McClain; William H. Magidson

[57] ABSTRACT

Disclosed is an apparatus and method for the recovery of hydrocarbon values from underground hydrocarbonaceous deposits comprising forming an underground reaction zone containing a mass of rubblized hydrocarbonaceous material; forming an essentially surface reaction zone containing a mass of rubblized hydrocarbonaceous material in fluid communication with the underground reaction zone; forming an underground product collection zone for the gathering and collection of hydrocarbon values, said zone being in fluid communication with the surface and underground reaction zones; passing a suitable fluid capable of removing hydrocarbon values from the rubblized material through the surface and underground reaction zones so as to effectively remove hydrocarbon values from such material; and passing the hydrocarbon values to the underground collection zone for recovery.

4 Claims, 1 Drawing Figure

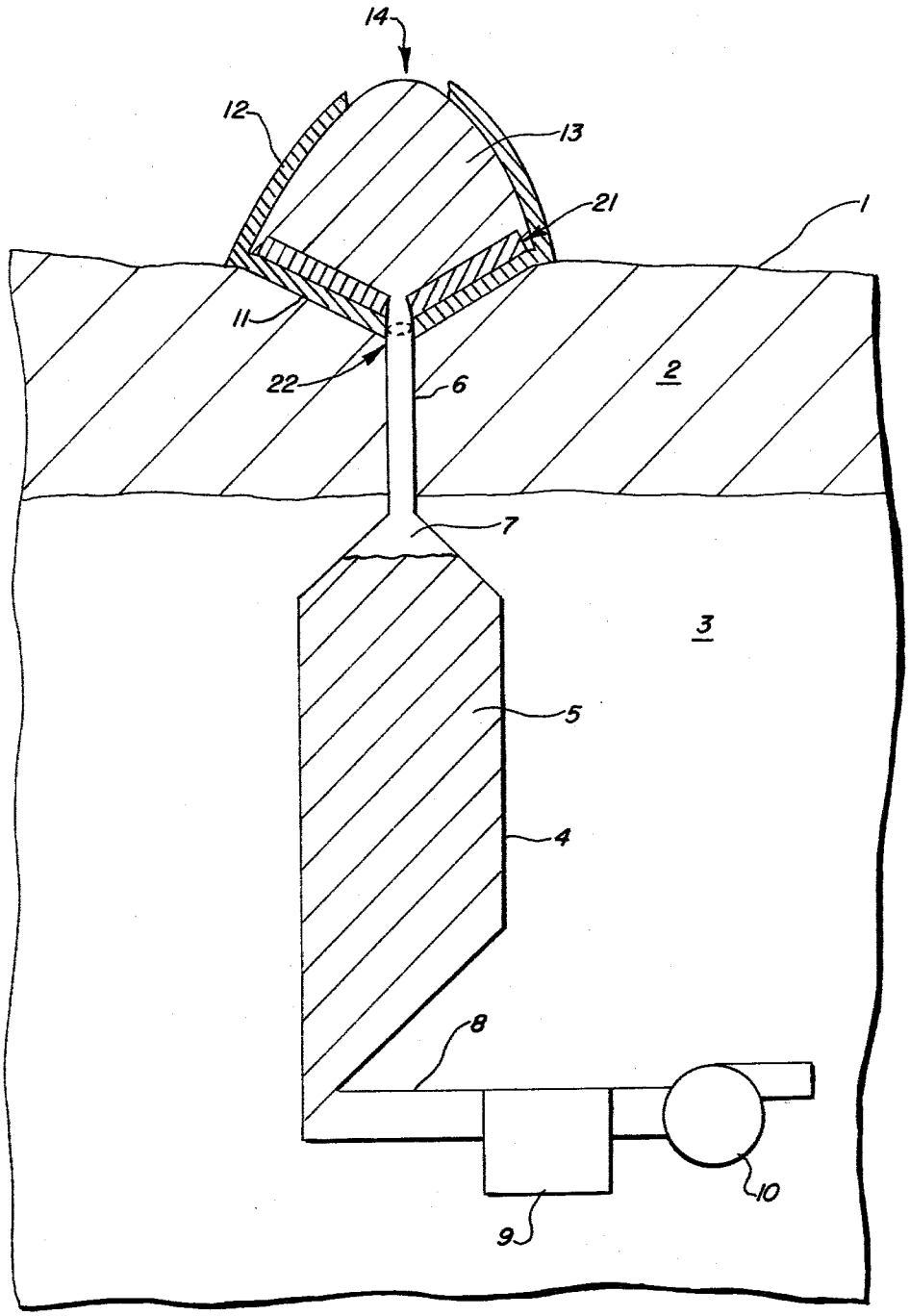
14
12
13
21
1
11
22
6
2
7
3
5
4
8
10
9

SURFACE AND SUBSURFACE HYDROCARBON RECOVERY

BACKGROUND

This invention relates to recovery of carbonaceous materials from underground deposits. More specifically, this invention relates to the surface and subsurface combustion or retorting of hydrocarbonaceous materials, and attendant product recovery.

Numerous hydrocarbonaceous materials are found in underground deposits; for example crude oil, coal, oil shale tar sands, and others. One method of recovering energy or hydrocarbon from such underground deposits is by combustion. An oxidizing gas such as air, sometimes in conjunction with diluents such as steam, can be provided to an underground combustion or retorting zone so as to combust a portion of the combustible material contained therein and either free hydrocarbon or thereby form materials which are suitable for energy recovery. For example, oxygen or air, and possibly steam, can be passed into a coal deposit so as to form off-gases having combustible materials such as light hydrocarbons and carbon monoxide. These gases can then be combusted directly for heat or energy recovered such as through power generation. Underground combustion can be used in the recovery of petroleum crude oil from certain types of deposits. Air or oxygen, and steam, is passed into an underground deposit and combustion initiated so hot combustion gases will aid in the recovery of such crude oil. Similar technique can be used in the recovery of oil from tar sands. One important use of underground combustion is in the recovery of oil from oil shale.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco countries, and Northwestern Colorado.

Oil shale contains organic material called kerogen which is a solid carbonaceous material from which shale oil can be produced. Commonly oil shale deposits have variable richness or kerogen content, the oil shale generally being stratified in horizontal layers. Upon heating oil shale to a sufficient temperature, kerogen is decomposed and a liquid is formed. Oil shale can be retorted to form a hydrocarbon liquid either by in situ or surface retorting. In surface retorting, oil shale is mined from the ground, brought to the surface, and placed in vessels where it is contacted with hot material, such as hot shale or gases for heat transfer. Hot retorting temperatures cause shale oil to be freed from the rock. Spent retorted oil shale which has been depleted in kerogen is removed from the reactor and discarded. Some well-known methods of surface retorting are the Tosco, Lurgi, and Paraho processes.

In the Tosco process ceramic balls heated by combustion of retort off-gas, contact shale in a horizontal rotary kiln. Kerogen is broken down and emanates from the kiln as gases which are fractionated to yield liquid products plus off-gas which is in turn combusted to heat the ceramic balls. Spent shale is separated from the ceramic balls by screening, cooled and sent to disposal. The ceramic balls are recycled to a heater.

In the Lurgi process carbon on spent shale is combusted in a riser heater. The hot spent shale is separated from combustion products and mixed with fresh shale feed in a sealed screw conveyor. Gases from this contact are fractionated to yield liquid products and combustible off-gas for use.

In the Paraho process fresh shale is fed to the top of a vertical shaft kiln, contacted with hot gases produced by either in situ combustion of coke on spent shale or externally heated recycle gas. Kerogen breakdown products are withdrawn from the kiln by vapor-collecting tubes near the top of the kiln. Spent shale is removed from the bottom of the kiln by a grate system. Vapors leaving the kiln are separated to yield oil product and combustible gas for use.

Another method of retorting oil shale is the in situ process. In situ retorting of oil shale generally comprises forming a retort or retorting zone underground, preferably within the oil shale zone. The retorting zone can be formed by mining an access tunnel to or near the retorting zone and then removing a portion of the oil shale deposit by conventional mining techniques. About 2 to about 40 percent, preferably about 15 to about 25 percent, of the oil shale in the retorting area is removed to provide void space in the retorting area. The oil shale in the retorting area is then rubblized by well-known mining techniques to provide a retort containing rubblized shale for retorting.

A common method for forming the underground retort is to undercut the deposit to be retorted and remove a portion of the deposit to provide void space. Explosives then are placed in the overlying or surrounding oil shale. These explosives are used to rubblize the shale, preferably forming an area of rubble having uniform particle size and a uniform distribution of gas channel sizes. Generally, the more shale removed, the better the chance of getting a uniform distribution in the rubblized shale, and also the more expensive the mining, hauling and surface retorting operations. Uniform distribution of the rubblized mass improves gas flow there through, and promotes even flame front advance and minimizes the likelihood of the flame front prematurely breaking through at one point of the bottom of the rubblized mass. Premature breakthrough can decrease the total oil yield from a retorting zone. Some of the techniques used for forming the rubblized area are room and pillar mining, sublevel caving, and the like. Because of the stratification of oil shale it is sometimes desirable to selectively mine material based on its mineral or kerogen content for removal from the retorting zone. Also because of stratification, the retorting zone may contain lean oil shale, or rock containing essentially no kerogen.

After the underground retort is formed, the mass of rubblized shale is subjected to retorting. Hot retorting gases are passed through the rubblized shale to effectively form and remove liquid hydrocarbon from the oil shale. This is commonly done by passing a gas such as air or air mixed with steam and/or hydrocarbons through the deposit. Most commonly, air is forced into one end of the retort and a fire or flame front initiated by the use of a burner or the addition of hydrocarbon such as natural gas, propane, and the like. Combustion is then maintained by the burning of coke on spent or partially spent oil shale, thereby producing hot off-gases suitable for retorting. This flame front is then passed slowly through the rubblized deposit to effect the retorting. Not only is shale oil effectively produced, but also a mixture of off-gases from the retorting is also formed. These gases contain hydrogen, carbon monoxide, ammonia, carbon dioxide, hydrogen sulfide, carbonyl sulfide, oxides of sulfur and nitrogen, and low molecular weight hydrocarbons. Generally a mixture of off-gases, water and shale oil are recovered from the retort. This mixture undergoes preliminary separation commonly by gravity to separate the gases from the liquid oil from the liquid water. A product recovery system is provided to separate retort products or by-products. Most commonly, the bottom of underground retorts is in fluid communication with a separation zone, generally at a lower level so that liquids can be transported by gravity flow. Fluid communication is generally provided by mined slots while the main separation zone is commonly a mined room to provide residence time for oil/water/gas separation.

A number of patents describe methods of in situ retorting of oil shale, such as Karrick, L. C., U.S. Pat. No. 1,913,395; Karrick, S. N. U.S. Pat. No. 1,919,636; Uren, U.S. Pat. No. 2,481,051; Van Poollen, U.S. Pat. No. 3,001,776; Ellington, U.S. Pat. No. 3,586,337; Prats, U.S. Pat. No. 3,434,757; Garrett, U.S. Pat. No. 3,661,423; Ridley, U.S. Pat. No. 3,951,456; and Lewis, U.S. Pat. No. 4,017,119 which are hereby incorporated by reference and made a part hereof.

Generally in forming underground in situ retorts, a portion of the formation is mined out and brought to the surface. In the formation of subterranean oil shale retorts, commonly about 2 to about 40, preferably about 15 to about 25 percent of the volume to be retorted is removed and brought to the surface. Because this material contains substantial amounts of recoverable hydrocarbon, it is preferable to retort such material above ground. As discussed previously, it can be done in large reactors such as the Tosco, Lurgi, or Paraho reactors. Another method of retorting such mine deposit is taught in Garrett, which teaches the piling of such material in an area and covering it with a mantle so as to contain gases and passing a hot retorting fluid through such pile to effectively retort the deposit. It generally requires a substantial capital investment to manufacture the large reactor vessels needed for the Tosco, Lurgi, and Paraho processes. It is also relatively expensive to haul the mined material to be retorted in a distant zone and to haul away and dispose spent shale. Generally, the aboveground retorts have a recovery system for the shale oil formed by retorting, and attendant by-products such as water, dust, and off-gases. This seems to be a duplication of the separation system already available underground. In some cases, waste heat present in the off-gases of surface retorting is not effectively used, and therefore reduces the ultimate total energy recovery from a given shale deposit.

It is an object of this invention to provide an improved process for the recovery of hydrocarbon from underground deposits.

It is an object of this invention to provide an underground retort and a substantially surface retort which will have a common recovery zone thereby reducing capital expense and providing a simple method for the recovery of energy from an underground deposit.

It is also an object of this invention to provide an improved design for oil shale retorts. By providing a less expensive method of removing and retorting mined shale, it is practical to remove a larger percentage of shale and thus obtain a rubblized retort with a more uniform distribution of gas channel sizes, and thus minimize flame front breakthrough and obtain higher oil recovery.

It is also an object of this invention to provide a method of retorting oil shale which minimizes the amount of haulage of rubblized matter and of spent shale.

SUMMARY OF THE INVENTION

The objects of this invention can be obtained by an improved process for the recovery of hydrocarbon values from underground hydrocarbonaceous deposits comprising forming an underground reaction zone containing a mass comprising rubblized hydrocarbonaceous material and forming an essentially surface reaction zone containing a mass comprising rubblized hydrocarbonaceous material in fluid communication with the underground reaction zone. An underground product collection zone for the gathering and collection of hydrocarbon values is formed, said zone being in fluid communication with the surface and the underground reaction zones. The various retorting and collection zones can be formed in any chronological order. A suitable fluid capable of removing hydrocarbon values from the rubblized material is passed through the surface and underground reaction zones so as to effectively remove hydrocarbon values from the rubblized matter. The hydrocarbon values obtained are then passed to the underground collection zone for recovery.

This process can be best understood when considering the retorting of oil shale so as to recover shale oil. Underground oil shale retorts are commonly formed by removing about 2 to about 40 percent of the oil shale from a retorting zone and expanding a portion of the oil shale remaining in the zone to provide a mass comprising rubblized oil shale in such zone. An underground collection system capable of collecting shale oil from such underground retort is provided in fluid communication with the retort. This is very commonly done by providing drainage paths at the bottom of the retort so that fluids passed into or formed in the retort can be easily collected. Most commonly this is done by a sloping bottom floor in the retort so that fluids such as liquids will pass along the floor through a passageway into a sump area, and can be gathered and removed therefrom. The gathering system generally also provides for the collection of gaseous materials. An aboveground retort is provided in fluid communication with the underground retort, said aboveground retort comprising a substantially aboveground zone containing a rubblized mass comprising oil shale which has previously been mined from the unrubblized retort below or from nearby retorts. The aboveground retorting zone preferably has a sloping floor so that shale oil formed in such retort will pass along the floor by gravity and pass to the underground retort to the collection system. The above-ground retort will generally be positioned substantially above the underground retort so as to minimize the amount of passageway between the two retorts, thereby minimizing costs.

The underground reaction zone comprises an underground zone whose boundaries are generally defined by unfragmented underground formations. In the case of oil shale retorting, the underground reaction zone comprises an underground retort which is located below the surface of the earth, generally at least partially within the oil shale deposit itself. Commonly the underground oil shale retort is located within the oil shale zone located below an overburden of rock and other materials.

In some cases the retort or the product collection zone can extend through or into zones containing little or no kerogen. These underground reaction zones can be produced by well-known techniques which have been described earlier in this patent application.

The essentially surface reaction zone comprises a zone substantially on the surface of the earth, most commonly directly above the underground reaction zone. This essentially surface reaction zone is bounded at least partly by the surface of the earth. For example, one of the zones can be created by removing a portion of the ground surface so as to provide a slight cavity, preferably with a sloping floor so as to provide good liquid drainage by gravity. Generally a sloping floor of at least approximately 1°, preferably at least 3° is preferred to provide adequate drainage. The ground is very commonly sealed with a layer of material relatively impermeable to liquid products such as shale oil and water and also to gaseous products such as air and combustion products. This layer which renders the ground relatively impermeable should also not be unduly adversely affected by high temperatures. The hot combustion gases passing or contacting such layer, should not render it permeable to such liquids and gases. Suitable materials for forming this impermeable layer on top of the sloping ground comprise clay, mud, cements, slurries of spent oil shale from surface retorting combined with water and possibly other materials so that they will form a coherent mass. In some cases the rubble mass can be covered or partially covered with plastic sheets to control air flow into the mass. Optionally the plastic sheets can be covered with spent oil shale, clay, mud and the like.

The hydrocarbonaceous material which is to be subjected to contact with fluids for hydrocarbon or energy recovery are then placed on top of the ground in the essentially surface reaction zone on top of the relatively impermeable layer. For example, mined oil shale can be hauled to the site and dumped carefully on top of the sloping floor and relatively impermeable layer so as to form a rubblized mass of oil shale of suitable size and size distribution for effective retorting. Generally it is preferred to at least partially surround the mass of hydrocarbonaceous material with another barrier so as to at least partially confine the hydrocarbonaceous material and control the flow of fluids such as air into and through the mass of rubble and the reaction zone. For example, the mass of rubble of oil shale in the essentially surface reaction zone can be at least partially surrounded by dirt, cement, clay, slurries of water and spent shale from surface retorting of oil shale, and tin plastic sheets. This surrounding barrier should control the flow of gases from or to the pile of rubblized material in the essentially surface reaction zone. The mass of material in such zone should be partially surrounded by the ground and by the additional surrounding layer so that approximately at least 50 percent of the surface of the outside boundaries of the rubblized mass are encompassed by such layers. Preferably at least about 90 percent, more preferably essentially all, of the side boundaries of the rubble pile are surrounded. This prevents air bypassing the flame zone and prevents reaction gases from escaping from the retort.

Fluid communication is provided between the essentially surface reaction zone and the underground reaction zone, generally by drill holes or tunnels. For example, the sloping floor of the essentially surface reaction zone should provide a drainage path for fluids so that they can pass into a tunnel or hole and then pass to the underground reaction zone. This is generally done by providing a drill hole connecting a low point in the sloping floor of the essentially surface reaction zone with the underground retort.

However, in some cases communication can be provided from the essentially surface reaction zone directly to the underground collection zone, thereby completely bypassing the underground retort.

The underground retort is in fluid communication with a collection zone suitable for collecting the various products and by-products of the combustion or retorting. For example, oil shale retorts commonly have sloping floors so that oil and water formed therein will pass along the sloping floor down into tunnels underneath the retort so that the liquids can pass readily by gravity. Combustion gases generally pass in the direction which they are moved by gas flow. Commonly a tunnel at the base of a retort passes such liquids or gases to a separation zone where a water/oil/gas separation is generally effected by gravity. However, in come cases, water/oil emulsions are formed which require futher treatment. The mixture of materials to be separated is commonly passed into a mined room underground to provide suitable residence time for this gravity separation. Therefore it can be seen that there is fluid communication between the underground retort and the collection zone and also communication between the essentially surface reaction zone and the collection zone. In some cases there is communication from the essentially surface retort zone to the underground reaction zone to the collection zone.

Fluids are commonly used to remove hydrocarbon values from hydrocarbonaceous materials. In the case of oil shale, a retorting fluid is used to convert the kerogen into a relatively fluid shale oil. Most commonly retorting fluids are hot gases formed by the combustion of carbon or hydrocarbonaceous materials. Because retorting temperatures are generally in excess of about 370° C., preferably in excess of 450° C. these retorting fluids are commonly generated in close proximity to the reaction zones. Most commonly the retorting fluids are generated by the combustion of either a portion of the hydrocarbonaceous deposit or by combustion of coke formed on the hydrocarbonaceous deposit. The retorting of oil shale deposits has been discussed earlier and is discussed widely in the art.

THE DRAWING

The enclosed schematic drawing is illustrative of the improved process and retorting apparatus of this invention.

Deposit 3, such as oil shale, is commonly found underground covered by overburden 2, and surface of the ground 1. Underground retorting zone 4 is generally provided within the hydrocarbonaceous deposit 3 by well known methods. Generally, access tunnels are provided from the surface to various portions of the underground area so that men and equipment can be provided to the retorting zone 4, or to near retorting zone 4. Generally, a limited amount of the deposit is removed so as to provide void space for the expansion of the surrounding deposit. After a portion of the deposit has been removed, explosives are placed in various positions in the deposit so as to fracture and rubblize the deposit and provide a relatively uniform rubblized mass of oil shale 5 within retorting zone 4. The gas channels in this rubblized shale should also be of uniform size.

The explosive expansion and rubblization of the deposit can be done by any one of numerous methods such as room and pillar mining, sublevel caving, crater retreat balsting, and other well-known means. Retorting zone 4 has a sloping bottom 20 so that fluids from the retorting zone can pass by gravity along the sloping floor 20 and into tunnel 8 and sump 9 for gathering and collection. Retorting zone 4 also has a small air space 7 above the rubblized matter 5 which provides for more uniform gas distribution. Commonly, the retort will be operated by passing a hot retort fluid such as combustion gases either alone or in conjunction with water, steam, $CO_2$, or others downwardly, thereby producing shale oil from the oil shale and having a mixture of shale oil, water, and off-gases passing downwardly to the sloping floor 20 and collection tunnel 8. Substantially above the underground retort an aboveground retort is formed. This is done by simple mining or earth movement techniques whereby an area having a sloping floor is formed substantially above the underground retort. A liquid impervious seal 21 such as clay or spent shale slurry may be needed on the sloping floor. Rubblized oil shale which was mined out of underground formations is piled into the aboveground retorting zone substantially above sloping floors 11. Generally, the sloping floors should have at least about a 2 percent angle of inclination to provide for proper drainage of liquids. The aboveground pile of rubblized matter 13 is then partially covered with a material 12 capable of substantially reducing the flow of gas into the sides of the pile. This can be formed by various muds or a slurry of spent shale from a Lurgi, Tosco, or Paraho retort which can form a relatively impervious, mechanically strong barrier. Thin sheets of plastic weighed down by overburden rock, clay, etc. can also be used. Preferably the barrier comprises a solidified slurry of water and spent shale from surface retorting. This material is provided over the rubblized mass 13 so as to prevent the bypass of air around a retorting zone or the escape of gas beyond a retorting zone. It should also be disposed so as to achieve proper gas distribution within the retorting zone so that the rubblized oil shale is effectively retorted. A means of fluid communication 6 is provided from the surface retorting zone to the underground retorting zone. This can be a simple means such as a tunnel drilled by well-known mining techniques through the overburden or through the formation itself. Also, pipes or other similar conduits can be used. Screens or grating 22 can be used to keep shale out of this zone 6.

Combustion is initiated in the surface retorting zone 14 at or near the top of the rubblized mass 13. This can be done by applying heat with burners or by spreading combustible materials such as fuel oils or hydrocarbons over or through top layers of the rubblized matter 13. Gas removal means 10 is operated so as to draw air through the rubblized matter 13. Hot combustion gases are formed by such combustion and flame front and are passed downwardly through the rubblized mass 13, thereby effectively retorting such oil shale and producing shale oil and other by-products. The flame front is advanced by continually drawing off gases through means 10, thereby moving the flame front slowly downwardly through the rubblized mass 13. Liquid and gaseous products are passed along the sloping floor 11 downwardly through connecting fluid communications means 6 and into retort zone 4. The hot off-gases from the aboveground retorting zone also help heat the formation below, thereby helping to fully recover the energy from waste heat. As in the aboveground zone, the flame front is advanced through the rubblized mass 5, thereby effectively removing hydrocarbonaceous materials from the oil shale and effectively retorting such oil shale. Liquid and gaseous products both from the aboveground retort and the underground retort are collected through the same collection system, the sloping floor 20, collection pipe 8, and sump 9. After retorting is essentially completed, the aboveground pile can be covered with surface material to restore the surface, or it can be leveled before being covered. In some cases, a portion can be passed through zone 6 so as to partially fill void space at the top of retort 4, thereby preventing surface subsidence.

Spent shale from surface retorting can be used to grout or slurry backfill the underground retort to stabilize the underground retort, prevent surface subsidence, and prevent backing of contaminants by underground water, as discussed in Knepper et al, U.S. Ser. No. 829,143 filed Aug. 30, 1977. However, calcination of the spent shale may be required.

I claim:

1. An improved process for the recovery of hydrocarbon values from underground hydrocarbonaceous deposits comprising forming an underground reaction zone containing a mass comprising rubblized hydrocarbonaceous material;

forming an essentially surface reaction zone containing a mass comprising rubblized hydrocarbonaceous material in fluid communication with the underground reaction zone;

forming an underground product collection zone for the gathering and collection of hydrocarbon values, said zone being in fluid communication with the surface and underground reaction zones;

passing suitable fluid capable of removing hydrocarbon values from the rubblized material through the surface and underground reaction zones so as to effectively remove hydrocarbon values from such material; and passing the hydrocarbon values to the underground collection zone for recovery.

2. A retorting apparatus for the recovery of shale oil from oil shale comprising an underground in situ retorting area comprising an underground zone containing a rubblized mass comprising oil shale;

an underground collection system in fluid communication with the underground retort, capable of collecting shale oil from such retort;

an aboveground retort in fluid communication with the underground retort, said aboveground retort comprising a substantially aboveground zone containing a rubblized mass comprising oil shale, said zone having a sealed sloping floor so that shale oil formed in such retort will pass along the floor and pass to the underground retort to the collection system.

3. A method of forming an apparatus for the recovery of shale oil from oil shale comprising forming an underground retort by removing about 2 to about 40 percent of the oil shale from a retorting zone and expanding a portion of the oil shale remaining in the zone to provide a mass comprising rubblized oil shale in such zone;

providing a shale oil recovery system in fluid communications with such underground retort;

forming a substantially aboveground retort having a sealed sloping floor and containing a mass comprising rubblized oil shale, said aboveground retort being in fluid communication with the underground retort so that shale oil produced in the substantially aboveground retort can be passed into the underground retort and shale oil recovery system.

4. An improved process for the recovery of hydrocarbon values from underground hydrocarbonaceous deposits comprising passing suitable fluid capable of removing hydrocarbon values from rubblized material through an essentially surface reaction zone and an underground reaction zone containing such material, said surface and underground reaction zones being in fluid communication with each other and also in fluid communication with an underground product collection zone for the gathering and collection of hydrocarbon values, so that hydrocarbon values are effectively removed from the rubblized material and passed to the collection zone for recovery.

* * * * *

UNITED STATES PATENT OFFICE
CERTIFICATE OF CORRECTION

Patent No. 4,241,952 Dated December 30, 1980

Inventor(s) Irwin Ginsburgh

It is certified that error appears in the above-identified patent and that said Letters Patent are hereby corrected as shown below:

| Patent Column | Line | |
|---|---|---|
| 5 | 51 | "tin" should be --thin-- |
| 6 | 21 | "come" should be --some-- |
| 6 | 22 | "futher" should be --further-- |
| 7 | 4 | "balsting" should be --blasting-- |
| 9 | 1-2 | "communications" should be --communication-- |

Signed and Sealed this

*Fourteenth* Day of *April 1981*

[SEAL]

*Attest:*

RENE D. TEGTMEYER

*Attesting Officer* *Acting Commissioner of Patents and Trademarks*